United States Patent [19]

High, Jr. et al.

[11] Patent Number: 4,765,747

[45] Date of Patent: Aug. 23, 1988

[54] FEED MIXING APPARATUS

[75] Inventors: Samuel E. High, Jr., Lititz; Aquila D. Mast, Lancaster, both of Pa.

[73] Assignee: Feedmobile, Inc., Lititz, Pa.

[21] Appl. No.: 118,499

[22] Filed: Nov. 9, 1987

[51] Int. Cl.[4] ..... B01F 7/08; B01F 7/24; B01F 15/02

[52] U.S. Cl. ..... 366/186; 366/293; 366/603

[58] Field of Search ..... 366/186, 194, 195, 196, 366/266, 292, 297, 298, 299, 300, 155, 156, 158, 318, 603

[56] References Cited

U.S. PATENT DOCUMENTS

| | | | |
|---|---|---|---|
| 3,129,927 | 4/1964 | Mast | 259/6 |
| 3,133,727 | 5/1964 | Luscombe | 366/266 |
| 3,254,878 | 6/1966 | Lorenzen | 366/266 |
| 3,804,377 | 4/1974 | Kugle | 366/292 |
| 4,432,499 | 2/1984 | Henkensieeken | 366/603 |
| 4,509,862 | 4/1985 | High et al. | 366/158 |
| 4,577,805 | 3/1986 | Seymour | 366/603 |

*Primary Examiner*—Robert W. Jenkins
*Attorney, Agent, or Firm*—Michael R. Swartz; John R. Flanagan

[57] ABSTRACT

A feed mixing apparatus includes a tank, and bottom and upright augers. The tank has a top wall, front and rear end walls, side walls and a bottom wall. The bottom auger is rotatably mounted and overlies the bottom wall. Tubular housing portions are disposed adjacent to opposite sides of the bottom auger at an intermediate location therealong, and are connected to and protrude from the exteriors of the side and bottom walls. One housing portion has a horizontal bottom end wall connected to and extending generally tangentially from the tank bottom wall. The upright augers are disposed at the intermediate location adjacent to opposite sides of the bottom auger and extend within and upwardly from the tubular housing portions. One upright auger is rotatably mounted to the top wall and the housing portion bottom end wall. Hydraulic motors are provided for driving the bottom and upright augers. One hydraulic motor is disposed on the exterior of housing portion bottom end wall and coupled to the one upright auger. The lower end of the one upright auger flight is disposed adjacent the housing portion bottom end wall at the level of the bottom of the bottom auger flight. Thus, the bottom auger is only required to push feed material along the housing portion horizontal bottom end wall to reach the lower end of the one upright auger flight.

19 Claims, 7 Drawing Sheets

FEED MIXING APPARATUS

BACKGROUND OF THE INVENTION

1. Field of the Invention

The present invention generally relates to feed material mixing and, more particularly, is concerned with a feed material mixing apparatus incorporating improvements in the arrangement of the mixing components of the apparatus and the control of their operating speeds.

2. Description of the Prior Art

In the preparation of feed for livestock consumption, it is conventional practice to mix various types of feed materials together with one another or with a suitable additive, such as molasses or some other liquid. For proper quality, it is imperative that such feed materials be thoroughly mixed at the proper speed.

One feed material mixing apparatus utilized heretofore for preparation of livestock feed is described and illustrated originally in U.S. Pat. No. 3,129,927 to Mast and more recently in U.S. Pat. No. 4,509,862 to High et al. Both of these patents are assigned to the assignee of the present invention. The mixing apparatus disclosed in these patents generally includes a tank having vertical front and rear end walls, upwardly diverging side walls and an arcuate bottom wall. Disposed above the bottom wall is a rotatably-mounted horizontal bottom auger which extends fore-and-aft between the tank front and rear end walls. Flights on forward and rearward portions of the bottom auger spiral in reversed relation such that rotation of the bottom auger conveys feed material away from the front and rear end walls of the tank and toward an intermediate location along the bottom auger. A pair of rotatably-mounted vertical augers are disposed adjacent opposite sides of the bottom auger at such intermediate location therealong. Respective flights of the vertical augers spiral in the same relation such that rotation of the vertical augers conveys feed material upwardly toward a top wall of the tank where the material then flows laterally toward the opposite side walls and forwardly and rearwardly toward the front and rear walls. As disclosed and illustrated in the High et al patent, the mixing apparatus also includes a rotatably-mounted horizontal top auger having flights that spiral in reversed relation such that rotation of the top auger conveys feed material away from the vertical augers and toward the front and rear tank end walls.

Thus, in the above-described mixing apparatus, portions of the feed material follows a plurality of generally circuitous paths within its tank to achieve thorough mixing thereof. Overall the above-described mixing apparatus has been very successful in producing a mixed and blended livestock feed of high quality. However, the apparatus does have certain limitations fostered primarily by the mechanical drive arrangement employed to rotatably drive its various augers.

One limitation is manifested in the positional relationship between the lower end of the flight of one of the vertical augers and the bottom of the flight of the bottom auger. The end of the one vertical auger terminates in a generally tubular housing portion connected to and protruding downwardly from the exterior of the one side wall adjacent to the bottom of the tank at the intermediate location of the vertical augers. Bevel gears coupling the one vertical auger and other components of the mechanical drive arrangement are provided in the bottom of the tubular housing portion. The space required for the bevel gears means that the lower end of the one vertical auger flight must begin at an elevation displaced above the bottom of the tubular housing portion which also displaces it above the bottom edge of the bottom auger flight.

Because of this positional relationship, an upwardly sloping transition member is provided to extend from below the bottom auger upwardly to the start of the flight of the vertical auger. The bottom auger is thus required to push feed material along the inclined path defined by the transition member upwardly to the start of the vertical auger flight. However, the bottom auger is only supported at its opposite ends. Such pushing action causes the bottom auger to flex and bow in a transverse relation to its axis, resulting in an increase in wear and reduction in the useful life of the bottom auger. Also, the addition of molasses to the feed material frequently results in material build up on the inclined transition member which causes added flexing and bowing of the bottom auger.

Another limitation relates to the fixed ratio established between the rotational speeds of the various augers by employment of the mechanical drive arrangement. The mechanical drive arrangement will not accommodate adjustment of the relative speed relationships between the augers.

Consequently, a need exists for improvements to the mixing apparatus of the aforementioned patents in order to eliminate these limitations.

SUMMARY OF THE INVENTION

The present invention provides an improved mixing apparatus designed to satisfy the aforementioned needs. The use of a drive system which utilizes hydraulic motors to respectively drive the bottom auger and one of the upright augers eliminates the space required to accommodate the mechanical drive components of the system used heretofore. The hydraulic drive system also provides greater flexibility in tailoring the operating speeds of the respective augers to the type of feed material being mixed.

Accordingly, the present invention is directed to a feed material mixing apparatus, wherein the combination comprises: a tank having a top wall, opposite front and rear end walls, upwardly diverging opposite side walls and an arcuate bottom wall; a bottom auger; and a pair of upright augers. The bottom auger is disposed in overlying relation along the arcuate bottom wall and is rotatably mounted to and extends fore-and-aft between the front and rear end walls. The bottom auger has flights on forward and rearward portions thereof which spiral in reversed relation such that rotation of the bottom auger conveys feed material along the bottom wall away from the front and rear end walls and toward an intermediate location along the bottom wall and side walls.

Further, the apparatus includes a pair of tubular housing portions disposed adjacent to opposite sides of the bottom auger at the intermediate location. The tubular housing portions are connected to and protrude vertically downwardly from the exterior of the respective opposite side walls and are connected to and protrude outwardly from opposite sides of the arcuate bottom wall. One of the housing portions has a generally horizontal bottom end wall connected to and extending generally tangentially from the arcuate bottom wall. The other of the housing portions is open at the bottom.

The pair of upright augers are disposed at the intermediate location adjacent to opposite sides of the bottom auger and extend within and upwardly from the respective tubular housing portions. One of the upright augers is rotatably mounted to the top wall and to the bottom end wall of one of the housing portions and the other of the upright augers is rotatably mount to the top wall and terminates short of the open bottom of the other housing portion. The upright augers have flights which spiral in the same relation such that rotation of the upright augers conveys feed material upwardly toward the top wall where the material then flows laterally toward the opposite side walls and forwardly and rearwardly toward the front and rear walls, following a plurality of generally circuitous paths within the tank to achieve thorough mixing thereof.

The apparatus also includes drive means for operating the bottom and upright augers. The drive means includes a pair of hydraulic motors. One of the motors is disposed on the exterior of one of the front and rear end walls and is drivingly coupled to the bottom auger. The other of the motors is disposed on the exterior of the bottom end wall of the one housing portion and is drivingly coupled to the one upright auger.

The lower end of the flight of the one upright auger is disposed adjacent the bottom end wall of the one housing portion and generally at the level of the bottom of the flight of the bottom auger. Thus, the bottom auger is only required to push feed material along the horizontal bottom end wall of the one housing portion to reach the lower end of the one upright auger flight. Also, insufficient unoccupied space remains between the lower end of the one upright auger flight and the one housing portion bottom end wall to allow any unwanted buildup of feed material.

These and other advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

FIG. **12*a*** is a schematic representation of the hydraulic drive arrangement of the apparatus wherein a control valve thereof is illustrated in a first condition for driving the components of the apparatus at full speed.

Figure 12A:
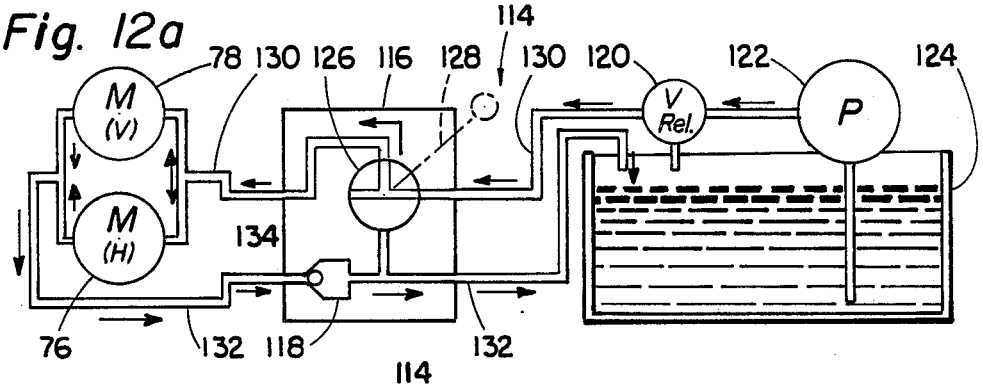

FIG. **12*b* is another schematic representation similar to that of FIG. 12*a*** but showing the control valve in a second condition for driving the components of the apparatus at reduced speed.

FIGS. **13*a* and 13*b*** are schematic representations of an alternative hydraulic drive arrangement of the apparatus for operating the horizontal auger at a speed different than that of the vertical augers.

DETAILED DESCRIPTION OF THE INVENTION

Figure 1:
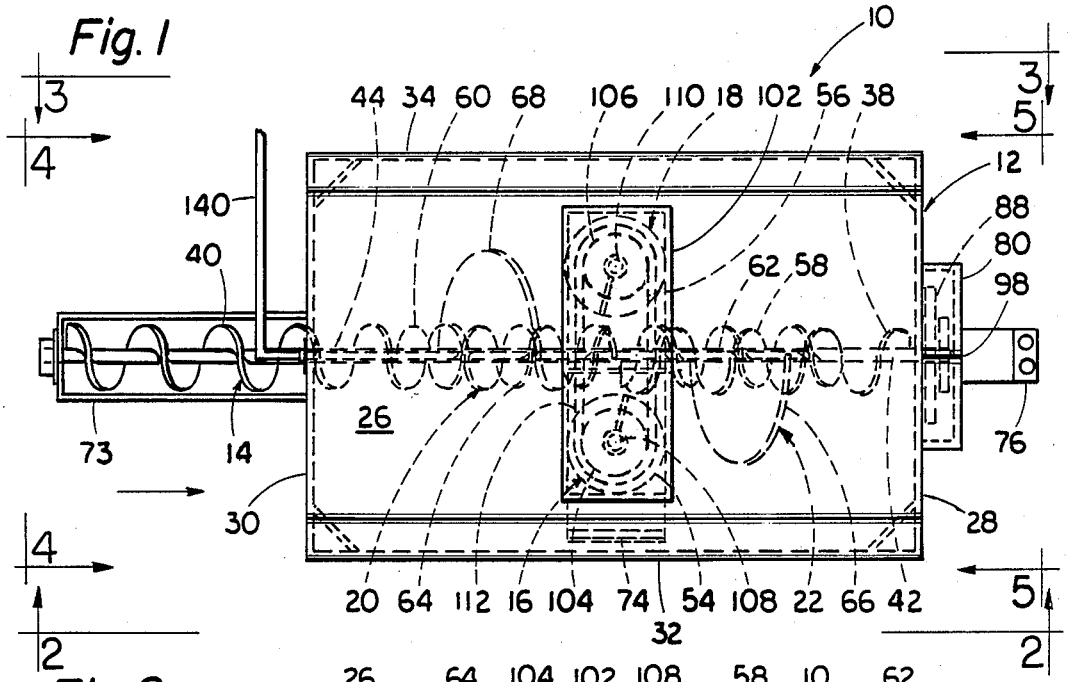
FIG. 1 is a top plan view of a feed material mixing apparatus embodying the improvements of the present invention.
Figure 2:
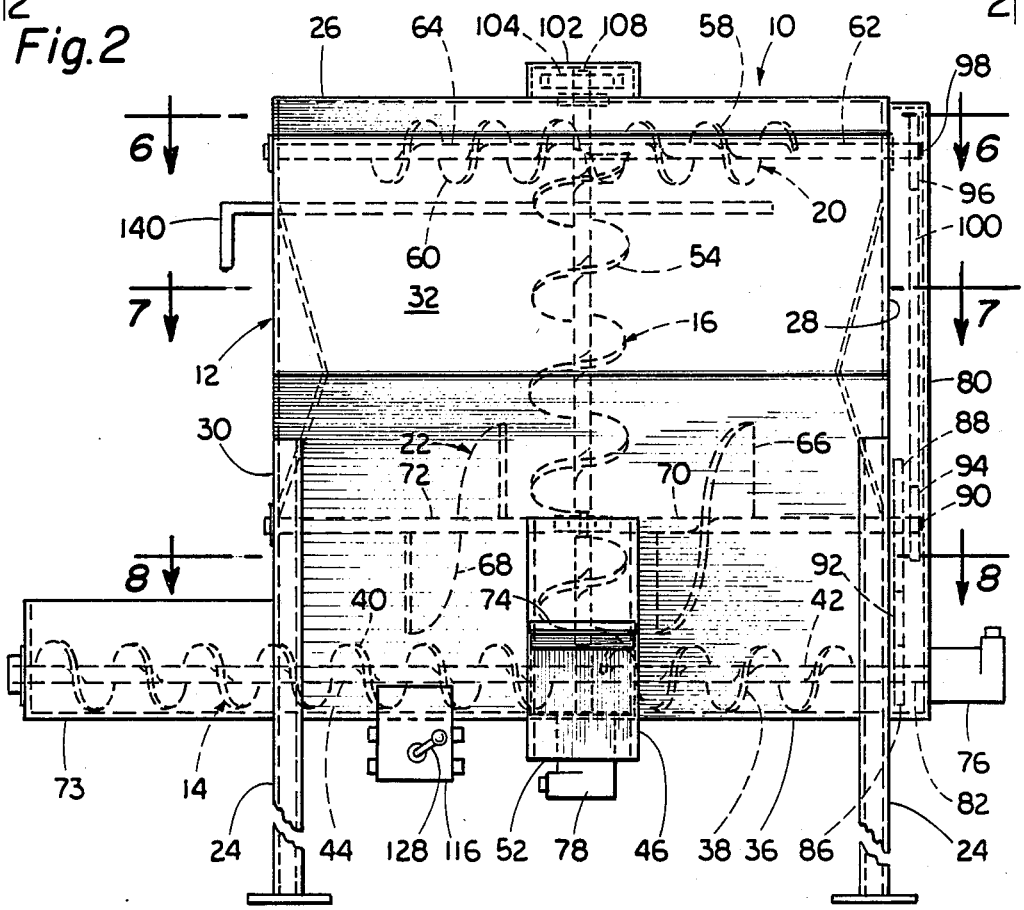
FIG. 2 is a right side elevational view of the apparatus as seen along line 2—2 of FIG. 1.
Figure 3:
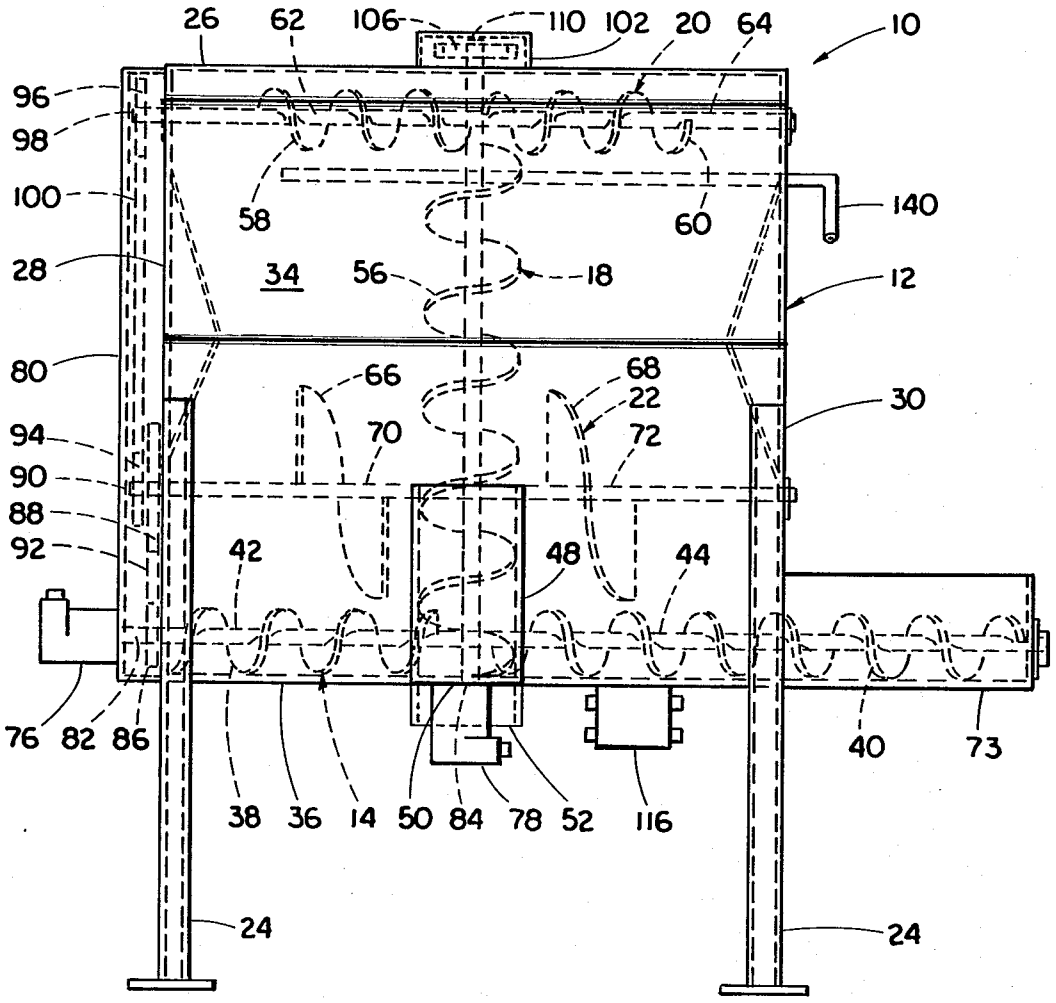
FIG. 3 is a left side elevational view of the apparatus as seen along line 3—3 of FIG. 1.
Figure 5:
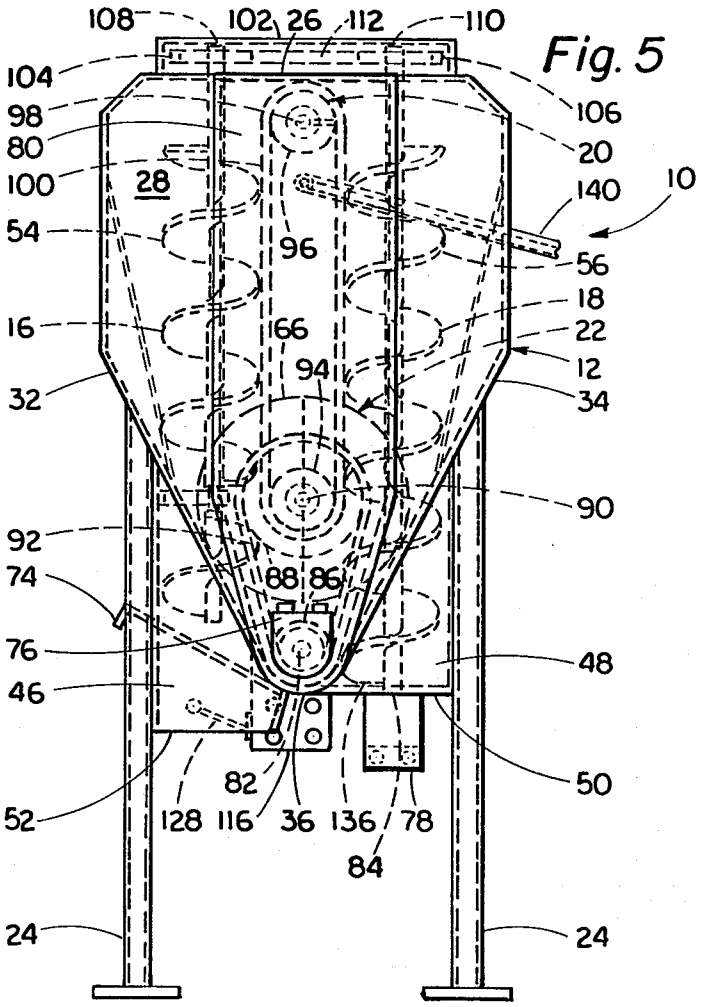
FIG. 5 is a front elevational view of the apparatus as seen along line 5—5 of FIG. 1.
Figure 4:
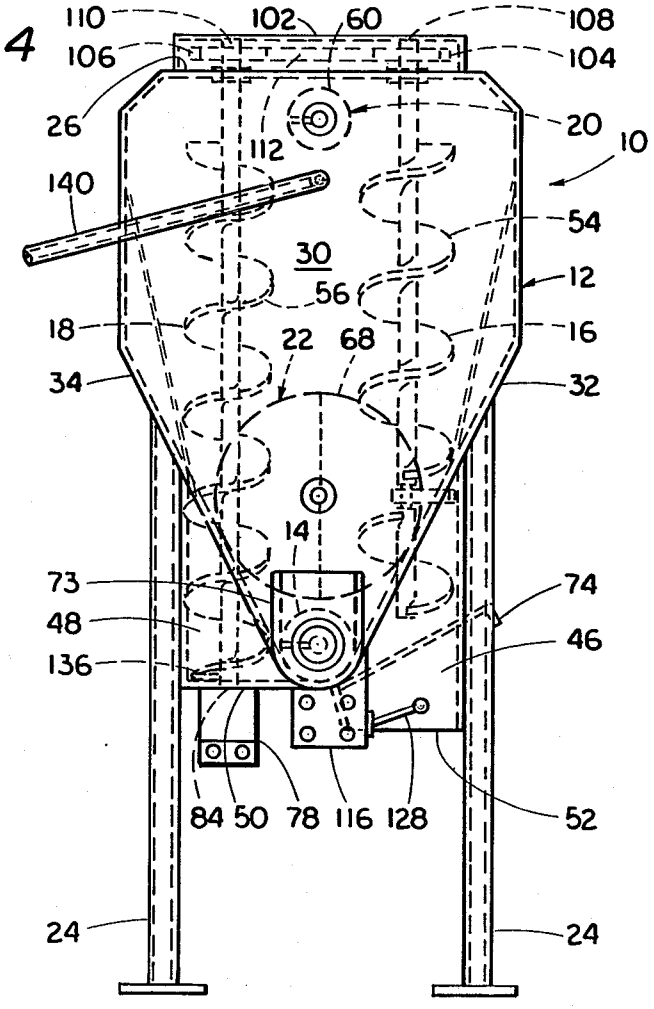
FIG. 4 is a rear elevational view of the apparatus as seen along line 4—4 of FIG. 1.
Figure 6:
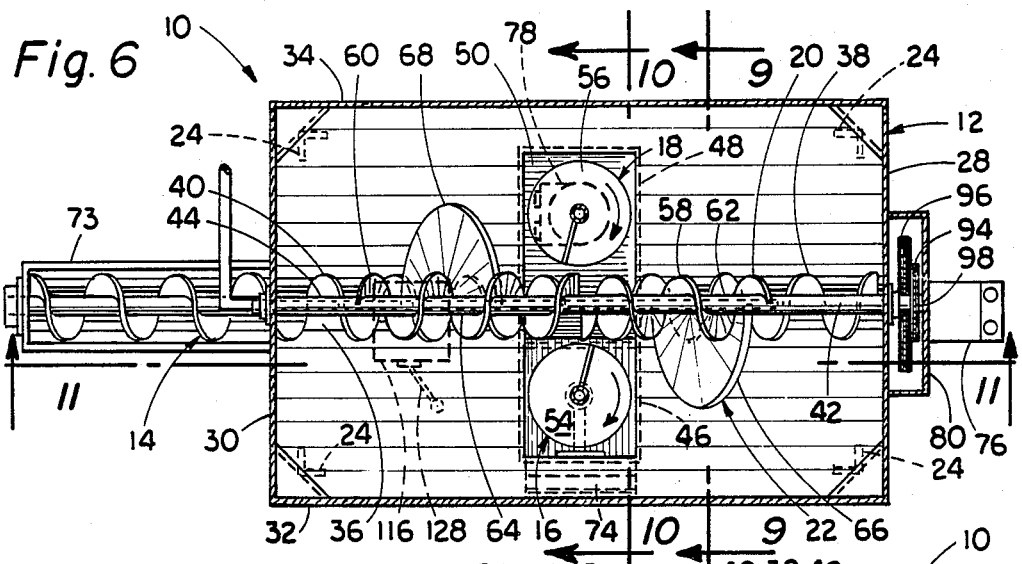
FIG. 6 is a fore-and-aft horizontal sectional view of the apparatus taken along line 6—6 of FIG. 2.
Figure 7:
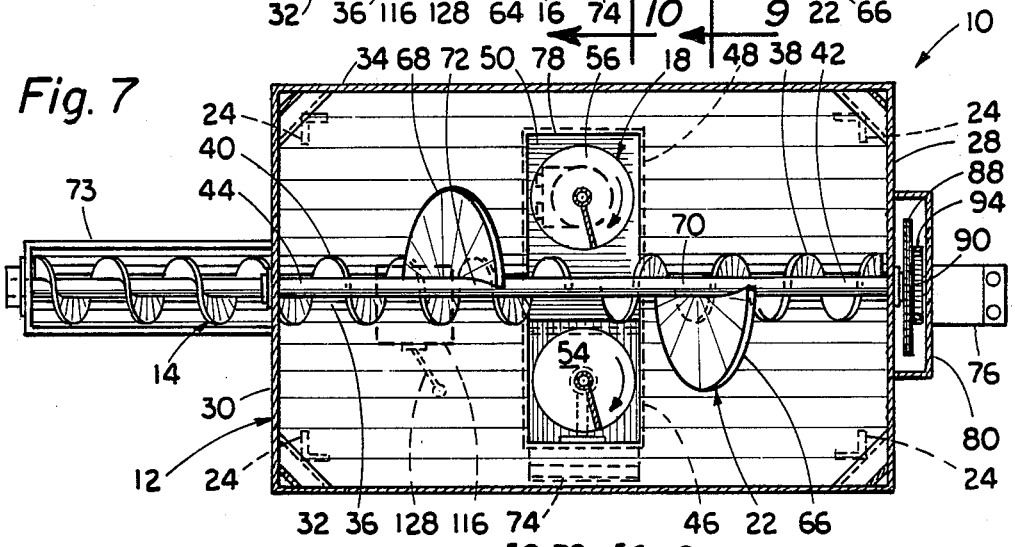
FIG. 7 is another fore-and-aft horizontal sectional view of the apparatus taken along line 7—7 of FIG. 2.
Figure 8:
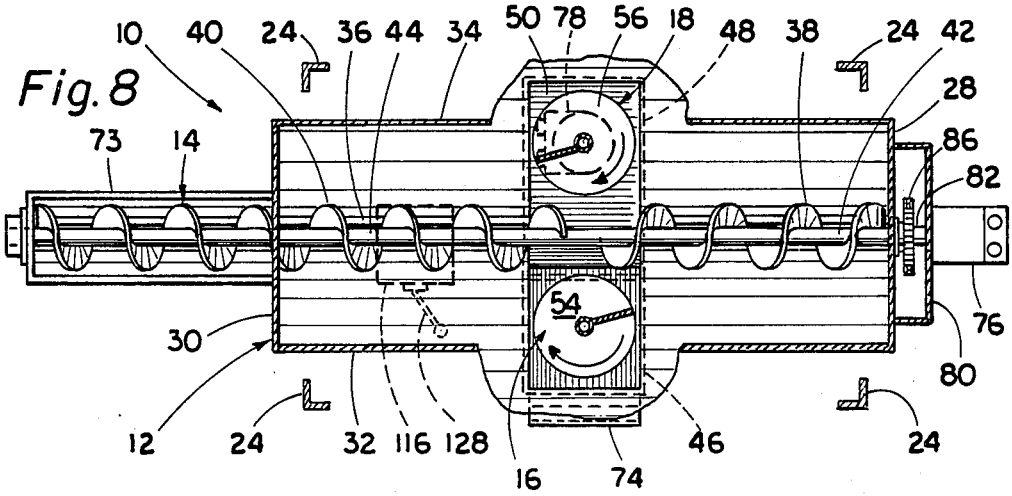
FIG. 8 is still another fore-and-aft horizontal sectional view of the apparatus taken along line 8—8 of FIG. 2.

In the following description, right and left hand references are determined by standing at the feed discharge end (or rear) of the apparatus and facing in the direction of the arrow in FIG. 1 (or toward the front of the apparatus). Also in the following description, it is to be understood that such terms as "forward", "left", "upwardly", etc., are words of convenience and are not to be construed as limiting terms.

Referring now to the drawings, and particularly to FIGS. 1–8, there is shown the preferred embodiment of a feed material mixing apparatus, generally designated by the numeral 10, which employs the improvements of the present invention. The mixing apparatus 10 basically includes a tank 12, a horizontal bottom auger 14, a pair of right and left upright augers 16,18, a horizontal top auger 20 and a horizontal intermediate auger 22.

Figure 10:
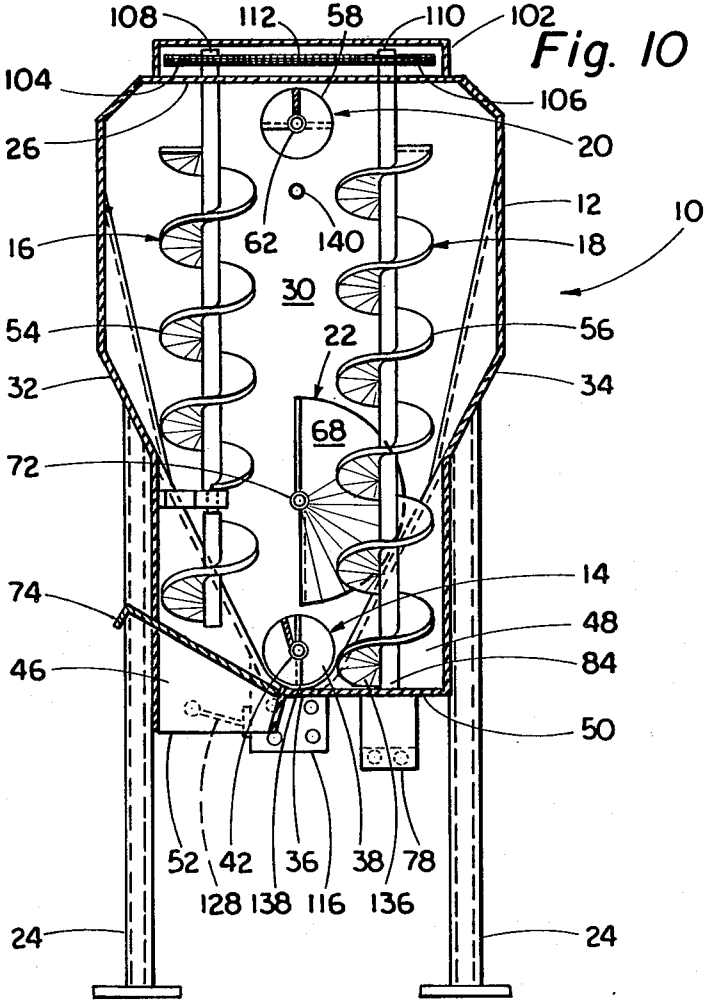
FIG. 10 is another transverse vertical sectional view of the apparatus taken along line 10—10 of FIG. 6.
Figure 9:
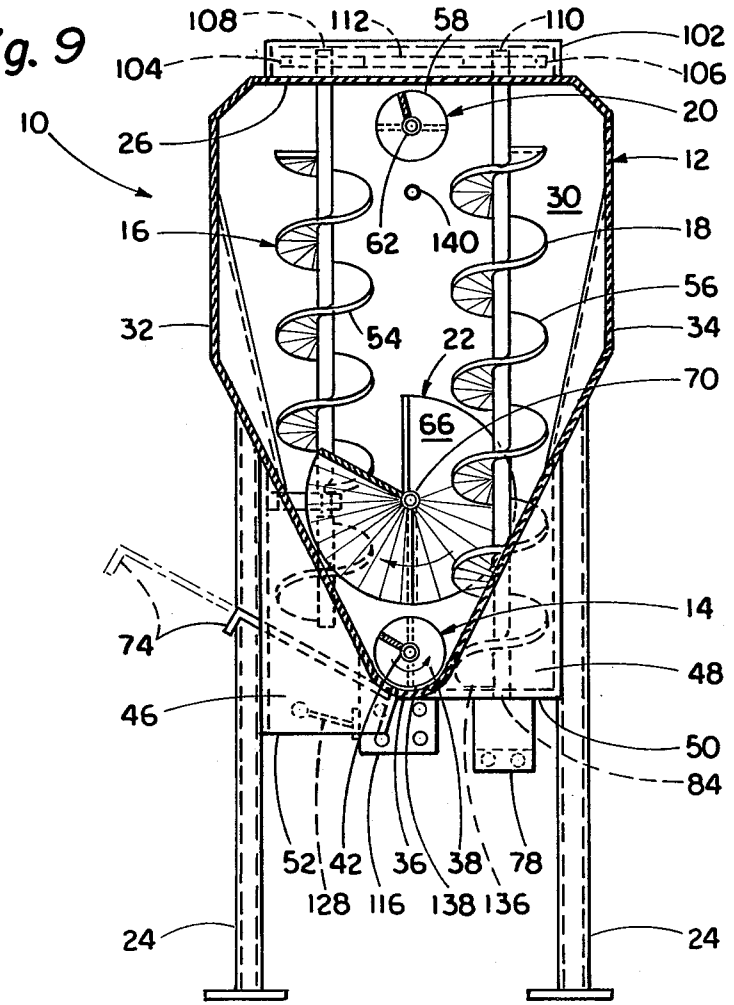
FIG. 9 is a transverse vertical sectional view of the apparatus taken along line 9—9 of FIG. 6.

More particularly, as also seen in FIGS. 9 and 10, the tank 12 is mounted above a support surface on a plurality of upright legs 24. The tank 12 has a top wall 26, generally vertical front and rear end walls 28,30, right and left side walls 32,34 and an arcuate bottom wall 36. The side walls 32,34 diverge upwardly to intermediate the height of the tank 12 and are generally vertical for the remaining portions of the side walls.

The bottom auger 14 is disposed in overlying relation along and above the arcuate bottom wall 36, extending fore-and-aft between and rotatably mounted at its opposite ends to the front and rear end walls 28,30. The bottom auger 14 has flights 38,40 on its forward and rearward portions 42,44 which spiral in reversed relation such that rotation of the bottom auger 14 conveys feed material away from the front and rear end walls 28,30 and toward an intermediate location along the side walls 32,34 and the bottom wall 36.

Further, the apparatus 10 includes a pair of right and left tubular housing portions 46,48 disposed adjacent to opposite sides of the bottom auger 14 at the intermediate location. The tubular housing portions 46,48 are connected to and protrude vertically downwardly from the exterior of the respective opposite side walls 32,34 and are connected to and protrude outwardly from opposite sides of the arcuate bottom wall 14. The left housing portion 48 has a generally horizontal bottom end wall 50 connected to and extending generally tangentially from the arcuate bottom wall 14. The right housing portion 46 is open at the bottom 52 thereof.

The upright augers 16,18 are disposed at the intermediate location adjacent to opposite sides of the bottom auger 14. The upright augers 16,18 extend within and upwardly from the respective tubular housing portions 46,48. The left upright auger 18 is rotatably mounted to the top wall 26 and to the bottom end wall 50 of the left housing portion 48. The right upright auger 16 is rotatably mounted to the top wall 26 but terminates short of the open bottom 52 of the right housing portion 46. The upright augers 16,18 have respective flights 54,56 which spiral in the same relation such that rotation of the upright augers 16,18 conveys feed material upwardly toward the top wall 26 of the tank 12 where the material then flows laterally toward the opposite side walls 32,34 and forwardly and rearwardly toward the front and rear walls 28,30.

The horizontal top auger 20 extends fore-and-aft of the tank 12 and between the upright augers 16,18. The top auger 20 also extends between and is rotatably mounted at its opposite ends to the front and rear end walls 28,30 of the tank 12. The top auger 20 has flights 58,60 on forward and rearward portions 62,64 thereof which spiral in reversed relation such that rotation of the top auger 20 conveys feed material away from the upper ends of the upright augers 16,18 and toward the front and rear end walls 28,30. The horizontal intermediate auger 22 extends fore-and-aft of the tank 12 and between the upright augers 16,18. The intermediate auger 22 also extends between and is rotatably mounted at its opposite ends to the front and rear end walls 28,30 of the tank 12. The intermediate auger 22 has flights 66,68 on forward and rearward portions 70,72 thereof which spiral in reversed relation such that rotation of the intermediate auger 22 conveys feed material away from the front and rear end walls 28,30 and toward the upright augers 16,18. Thus, in the above-described mixing apparatus the feed material follows a plurality of generally circuitous paths within its tank to achieve thorough mixing thereof.

The rearward portion 44 of the bottom auger 14 is longer than the forward portion 42 thereof such that the auger rearward portion 44 extends through rear end wall 30 of the tank 12 within a feed material inlet trough 73 attached to exterior of the tank rear end wall 30. The bottom auger 14 at its rear end is rotatable mounted to the rear end of the trough 73. A gate or door 74 is slidably mounted to the right housing portion 46 across the open bottom 52 thereof. Sliding of the door 74 from its solid to broken line positions in FIG. 9 allows feed to be discharge downwardly through the open bottom 52 of the right housing portion 46 on the tank 12.

Figure 11:
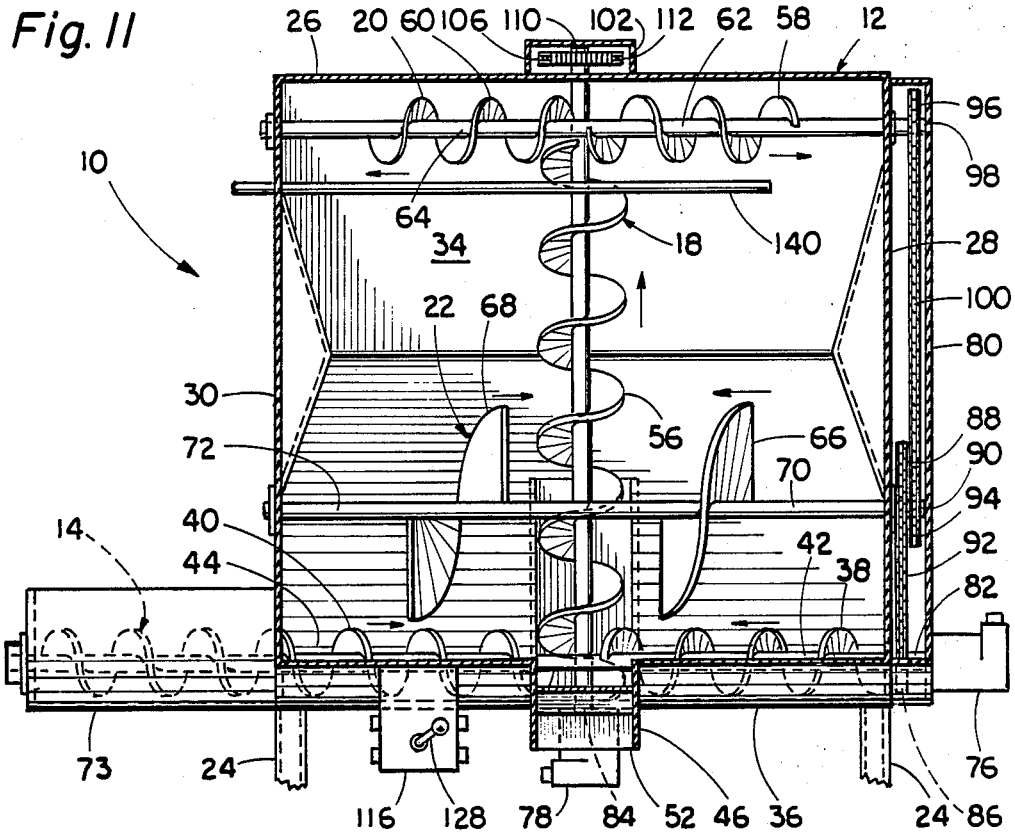
FIG. 11 is a fore-and-aft vertical sectional view of the apparatus taken along line 11—11 of FIG. 6.

Referring also to FIGS. 9–11, the apparatus 10 includes improvements in its drive means for operating the bottom auger 14, the upright augers 16,18, the top auger 20 and the intermediate auger 22. These improvements in the drive means relate to employment of a pair of hydraulic motors 76,78 for respectively rotatably driving the bottom auger 14 and upright augers 16,18. One hydraulic motor 76 is disposed on the exterior of the front end wall 28 of the tank 12 and is drivingly coupled to the bottom auger 14. In particular, the motor 76 is mounted on a housing 80 attached to the front end wall 28 and coupled to one shaft end 82 of the bottom auger 14 which extends through the housing 80. The other hydraulic motor 78 is disposed on the exterior of and attached to the bottom end wall 50 of the left housing portion 48 and is drivingly coupled to lower shaft end 84 of the left upright auger 18.

The drive means also includes components which transmit the rotary motion of the bottom and left upright augers 14,18 to the other augers. Specifically, sprockets 86,88 are provided within the housing 80 respectively on the one shaft end 82 of the bottom auger 14 and one shaft end 90 of the intermediate auger 22. An endless chain 92 is also disposed within the housing 80, extending between and entrained about the sprockets 86,88 for transmitting rotation of the bottom auger 14 to the intermediate auger 22. Further, sprockets 94,96 are provided within the housing 80 respectively on the one shaft end 90 of the intermediate auger 22 and one shaft end 98 of the top auger 20. An endless chain 100 is disposed within the housing 80 so as to extend between and be entrained about the sprockets 94,96 for transmitting rotation of the intermediate auger 22 to the top auger 20. Finally, within another housing 102 on the exterior of the top wall 26 of the tank 12, sprockets 104,106 are provided on the upper shaft ends 108,110 of the upright augers 16,18. An endless chain 112 disposed within the housing 102 extends between and about the sprockets 104,106 for transmitting rotation of the left upright auger 16 to the right upright auger 18.

Figure 12B:
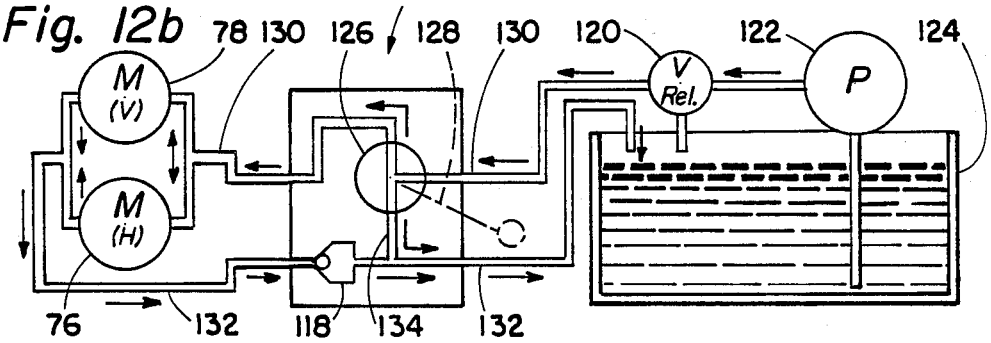
Figure 13A:
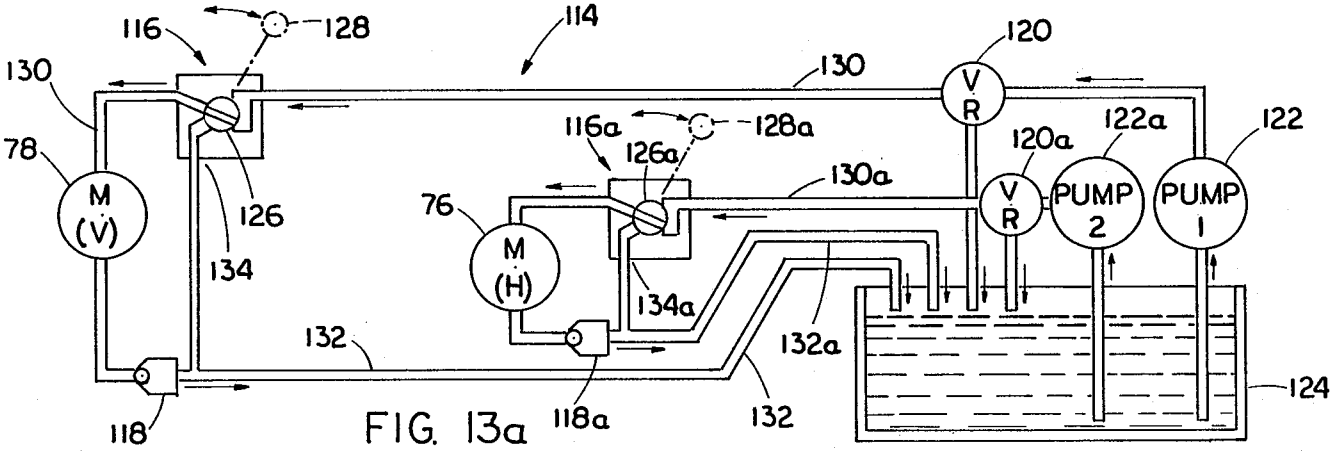
Figure 13B:
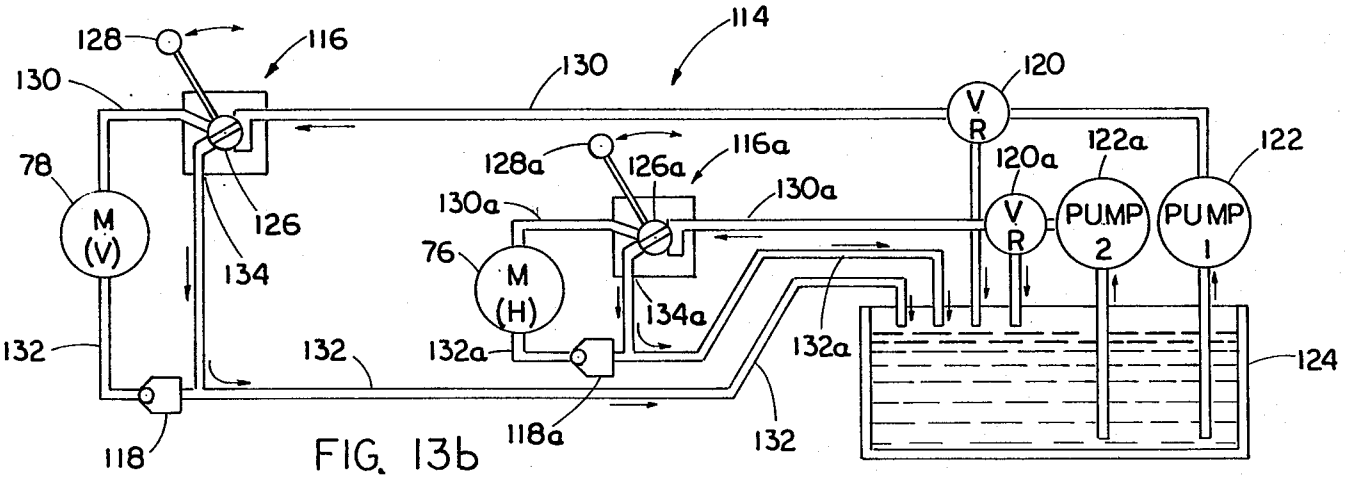

In FIGS. **12*a* and 12*b*, there is shown one example of a hydraulic circuit 114 of the drive means for controlling operation of the hydraulic motors 76,78. The illustrated hydraulic circuit 114 includes a control valve 116, a check valve 118, a relief valve 120, a pump 122 and a fluid reservoir 124. The angular position of a rotatable spool 126 of the control valve 116 is changed by use of a lever 128 connected thereto. When the spool 126 of the control valve 116 is in its first condition shown in FIG. 12*a*, fluid is pumped via a fluid supply flow path 130 from the pump 122 solely to the hydraulic motors 76,78. Since the motors are connected in parallel, they operate at the same speeds. Fluid returns via a fluid return flow path 132 through the check valve 118 to the reservoir 124. When the spool 126 is in its second condition shown in FIG. 12*b*, fluid is pumped via the fluid supply flow path 130 from the pump 122 to the hydraulic motors 76,78 and via an auxiliary flow path 134 bypassing the motors back to the reservoir 124 via return flow path 132. Therefore, in the second condition, the motors 76,78 do not operate at full speed. For example, the motors 76,78 operate at half speed when the control valve 116** is in the second condition. Preferably, the faster or full speed is used for mixing the feed material, whereas the slower speed is used in unloading the mixed feed.

Referring to FIGS. **13*a* and 13*b*, it should be understood that the respective motors 76,78 can be operated at different speeds by providing two separate control valves 116,116*a* and two separate pumps 122,122*a*. Each control valve 116,116*a* is connected independently between its respective pump 122,122*a* and one of the respective motors 76,78. Components associated with control valve 116 and pump 122 have the same reference numerals as in FIGS. 12*a* and 12*b*. Components associated with control valve 116*a* and pump 122*a* have the same reference numerals as in FIGS. 12*a* and 12*b* and are accompanied with the suffix "a". The individual circuit associated with each motor 76,78 is operated to control the speed of the motor in the same manner with respect to the circuit shown in FIGS. 12*a* and 12*b*. Operation of the motors 76,78 at different speeds causes the horizontal augers 14,20,22 to operate at a speed different than the speed of the upright augers 16,18**.

The use of the hydraulic motors 76,78 allows improvement of the positional relationship between the flight 56 of the left upright auger 18 and the forward flight 38 of the bottom auger 14. Specifically, the lower end 136 of the flight 56 of the left upright auger 18 is disposed adjacent the bottom end wall 50 of the left housing portion 48 and generally at the level of the bottom of the flights 38,40 of the bottom auger 14. Thus, the bottom auger 14 is only required to push feed material along the horizontal bottom end wall 50 of the left housing portion 48 to reach the lower end 136 of the left upright auger flight 56. Also, insufficient unoccupied space remains between the lower end 136 of the one upright auger flight 56 and the left housing portion bottom end wall 50 to allow any unwanted buildup of feed material. As a result, wear of the bottom auger 14 and power consumption by the mixing apparatus 10 are reduced.

The tank 12 of the mixing apparatus 10 is also provided with a conduit 140 for supplying and injecting a liquid additive, such as molasses, within the tank 12 for mixing with the feed material.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

We claim:

1. In a feed material mixing apparatus, the combination comprising:

(a) a tank having a top wall, opposite front and rear end walls, upwardly diverging opposite side walls and an arcuate bottom wall;

(b) a bottom auger disposed in overlying relation along said arcuate bottom wall and being rotatably mounted to and extending fore-and-aft between said front and rear end walls, said bottom auger having flights which convey feed material along said bottom wall away from said front and rear end walls and toward an intermediate location along said bottom wall and side walls;

(c) a pair of tubular housing portions disposed adjacent to opposite sides of said bottom auger at said intermediate location, said tubular housing portions being connected to and protruding outwardly from the exterior of said respective opposite side walls and bottom wall, one of said housing portions having a generally horizontal bottom end wall connected to and extending generally tangentially from said arcuate bottom wall; and (d) a pair of upright augers disposed at said intermediate location adjacent to opposite sides of said bottom auger and extending within and upwardly from said respective tubular housing portions, one of said upright augers being rotatably mounted to said top wall and to said bottom end wall of said one housing portion, said upright augers having flights which convey feed material upwardly toward said top wall where the material then flows laterally toward said opposite side walls and forwardly and rearwardly toward said front and rear walls, following a plurality of generally circuitous paths within said tank to achieve thorough mixing thereof;

(e) said flight of said one upright auger having a lower end being disposed adjacent said bottom end wall of said one housing portion and generally at the level of a bottom of said flight of said bottom auger such that said bottom auger is only required to push feed material along said horizontal bottom end wall of said one housing portion to reach said lower end of said one upright auger flight.

2. The apparatus as recited in claim 1, further comprising:

(f) drive means for operating said bottom and upright augers, said drive means including one hydraulic motor disposed on the exterior of said bottom end wall of said one housing portion and driving coupled to said one upright auger.

3. The apparatus as recited in claim 2, wherein said drive means further includes a drive train drivingly coupling said one upright auger to the other upright auger at the exterior of said top wall of said tank.

4. The apparatus as recited in claim 2, wherein said drive means further includes another hydraulic motor disposed on the exterior of one of said front and rear end walls and drivingly coupled to said bottom auger.

5. The apparatus as recited in claim 4, wherein said drive means also includes control means coupled to said hydraulic motors and being actuatable for operating said hydraulic motors and thereby said respective augers at different speeds.

6. The apparatus as recited in claim 1, further comprising:

(f) drive means for operating said bottom and upright augers, said drive means including separate hydraulic circuits for operating said bottom auger at a speed different than the speed of said upright augers.

7. In a feed material mixing apparatus, the combination comprising:

(a) a tank having a top wall, opposite front and rear end walls, upwardly diverging opposite side walls and an arcuate bottom wall;

(b) a bottom auger disposed in overlying relation along said arcuate bottom wall and being rotatably mounted to and extending fore-and-aft between said front and rear end walls, said bottom auger having flights on forward and rearward portions thereof which spiral in reversed relation such that rotation of said bottom auger conveys feed material along said bottom wall away from said front and rear end walls and toward an intermediate location along said bottom wall and side walls;

(c) a pair of tubular housing portions disposed adjacent to opposite sides of said bottom auger at said intermediate location, said tubular housing portions being connected to and protruding vertically downwardly from the exterior of said respective opposite side walls and connected to and protruding outwardly from opposite sides of said arcuate bottom wall, one of said housing portions having a generally horizontal bottom end wall connected to and extending generally tangentially from said arcuate bottom wall and the other of said housing portions being open at a bottom thereof; and (d) a pair of upright augers disposed at said intermediate location adjacent to opposite sides of said bottom auger and extending within and upwardly from said respective tubular housing portions, one of said upright augers being rotatably mounted to said top wall and to said bottom end wall of said one housing portion and the other of said upright augers being rotatably mount to said top wall and terminating short of said open bottom of the other housing portion, said upright augers having flights which spiral in the same direction such that rotation of said upright augers convey feed material upwardly toward said top wall where the material then flows laterally toward said opposite side walls and forwardly and rearwardly toward said front and rear walls, following a plurality of generally circuitous paths within said tank to achieve thorough mixing thereof;

(e) said flight of said one upright auger having a lower end disposed adjacent said bottom end wall of said one housing portion and generally at the level of the bottom of said flight of said bottom auger such that said bottom auger is only required to push feed material along said horizontal bottom end wall of said one housing portion to reach said lower end of said one upright auger flight.

8. In a feed material mixing apparatus, the combination comprising:

(a) a tank having a top wall, opposite front and rear end walls, upwardly diverging opposite side walls and an arcuate bottom wall;

(b) a bottom auger disposed in overlying relation along said arcuate bottom wall and being rotatably mounted to and extending fore-and-aft between said front and rear end walls for conveying feed material along said bottom wall away from said front and rear end walls and toward an intermediate location along said bottom wall and side walls;

(c) a pair of tubular housing portions disposed adjacent to opposite sides of said bottom auger at said intermediate location, said tubular housing portions being connected to and protruding outwardly from the exterior of said respective opposite side walls and bottom wall, one of said housing portions having a generally horizontal bottom end wall connected to and extending generally tangentially from said arcuate bottom wall;

(d) a pair of upright augers disposed at said intermediate location adjacent to opposite sides of said bottom auger and extending within and upwardly from said respective tubular housing portions, one of said upright augers being rotatably mounted to said top wall and to said bottom end wall of said one housing portion for conveying feed material upwardly toward said top wall where the material then flows laterally toward said opposite side walls and forwardly and rearwardly toward said front and rear walls, following a plurality of generally circuitous paths within said tank to achieve thorough mixing thereof; and (e) drive means for operating said bottom and upright augers, said drive means including one hydraulic motor disposed on the exterior of said bottom end wall of said one housing portion and driving coupled to said one upright auger.

9. The apparatus as recited in claim 8, wherein said drive means further includes another hydraulic motor disposed on the exterior of one of said front and rear end walls and drivingly coupled to said bottom auger.

10. The apparatus as recited in claim 9, wherein said drive means also includes control means coupled to said hydraulic motors and being actuatable for operating said hydraulic motors and thereby said respective augers at different speeds.

11. The apparatus as recited in claim 10, wherein said control means are actuatable for operating said one hydraulic motor and thereby said upright auger at a speed different than that of said other hydraulic motor and thereby said bottom auger.

12. The apparatus as recited in claim 8, wherein said drive means further includes a drive train drivingly coupling said one upright auger to the other upright auger at the exterior of said top wall of said tank.

13. In a feed material mixing apparatus, the combination comprising:

(a) a tank having a top wall, opposite front and rear end walls, upwardly diverging opposite side walls and an arcuate bottom wall;

(b) a bottom auger disposed in overlying relation along said arcuate bottom wall and being rotatably mounted to and extending fore-and-aft between said front and rear end walls, said bottom auger having flights on forward and rearward portions thereof which spiral in reversed relation such that rotation of said bottom auger conveys feed material along said bottom wall away from said front and rear end walls and toward an intermediate location along said bottom wall and side walls;

(c) a pair of tubular housing portions disposed adjacent to opposite sides of said bottom auger at said intermediate location, said tubular housing portions being connected to and protruding vertically downwardly from the exterior of said respective opposite side walls and connected to and protruding outwardly from opposite sides of said arcuate bottom wall, one of said housing portions having a generally horizontal bottom end wall connected to and extending generally tangentially from said arcuate bottom wall and the other of said housing portions being open at a bottom thereof;

(d) a pair of upright augers disposed at said intermediate location adjacent to opposite sides of said bottom auger and extending within and upwardly from said respective tubular housing portions, one of said upright augers being rotatably mounted to said top wall and to said bottom end wall of said one housing portion and the other of said upright augers being rotatably mount to said top wall and terminating short of said open bottom of the other housing portion, said upright augers having flights which spiral in the same direction such that rotation of said upright augers convey feed material upwardly toward said top wall where the material then flows laterally toward said opposite side walls and forwardly and rearwardly toward said front and rear walls, following a plurality of generally circuitous paths within said tank to achieve thorough mixing thereof; and (e) drive means for operating said bottom and upright augers, said drive means including a pair of hydraulic motors, one of said motors being disposed on the exterior of one of said front and rear end walls and drivingly coupled to said bottom auger, the other of said motors being disposed on the exterior of said bottom end wall of said one housing portion and drivingly coupled to said one upright auger.

14. The apparatus as recited in claim 13, wherein said drive means also includes control means coupled to said hydraulic motors and being actuatable for operating said hydraulic motors and thereby said respective augers at different speeds.

15. The apparatus as recited in claim 13, wherein said drive means further includes a drive train drivingly coupling said one upright auger to the other upright auger at the exterior of said top wall of said tank.

16. In a feed material mixing apparatus, the combination comprising:

(a) a tank having a top wall, opposite front and rear end walls, upwardly diverging opposite side walls and an arcuate bottom wall;

(b) a bottom auger disposed in overlying relation along said arcuate bottom wall and being rotatably mounted to and extending fore-and-aft between said front and rear end walls, said bottom auger having flights on forward and rearward portions thereof which spiral in reversed relation such that rotation of said bottom auger conveys feed material along said bottom wall away from said front and rear end walls and toward an intermediate location along said bottom wall and side walls;

(c) a pair of tubular housing portions disposed adjacent to opposite sides of said bottom auger at said intermediate location, said tubular housing portions being connected to and protruding vertically downwardly from the exterior of said respective opposite side walls and connected to and protruding outwardly from opposite sides of said arcuate bottom wall, one of said housing portions having a generally horizontal bottom end wall connected to and extending generally tangentially from said arcuate bottom wall and the other of said housing portions being open at a bottom thereof;

(d) a pair of upright augers disposed at said intermediate location adjacent to opposite sides of said bottom auger and extending within and upwardly from said respective tubular housing portions, one of said upright augers being rotatably mounted to said top wall and to said bottom end wall of said one housing portion and the other of said upright augers being rotatably mount to said top wall and terminating short of said open bottom of the other housing portion, said upright augers having flights which spiral in the same direction such that rotation of said upright augers convey feed material upwardly toward said top wall where the material then flows laterally toward said opposite side walls and forwardly and rearwardly toward said front and rear walls, following a plurality of generally circuitous paths within said tank to achieve thorough mixing thereof; and (e) drive means for operating said bottom and upright augers, said drive means including a pair of hydraulic motors, one of said motors being disposed on the exterior of one of said front and rear end walls and drivingly coupled to said bottom auger, the other of said motors being disposed on the exterior of said bottom end wall of said one housing portion and drivingly coupled to said one upright auger;

(f) said flight of said one upright auger having an lower end disposed adjacent said bottom end wall of said one housing portion and generally at the level of the bottom of said flight of said bottom auger such that said bottom auger is only required to push feed material along said horizontal bottom end wall of said one housing portion to reach said lower end of said one upright auger flight, said position of said lower end of said one upright auger flight and said housing portion bottom end wall being such that insufficient unoccupied space remains therebetween to allow unwanted buildup of feed material.

17. The apparatus as recited in claim 16, wherein said drive means also includes control means coupled to said hydraulic motors and being actuatable for operating said hydraulic motors and thereby said respective augers at different speeds.

18. The apparatus as recited in claim 16, wherein said control means are actuatable for operating said other hydraulic motor and thereby said bottom auger at a speed different than that of said one hydraulic motor and thereby said upright auger.

19. The apparatus as recited in claim 16, wherein said drive means further includes a drive train drivingly coupling said one upright auger to the other upright auger at the exterior of said top wall of said tank.

* * * * *